US006461120B2

(12) United States Patent
Harakawa et al.

(10) Patent No.: US 6,461,120 B2
(45) Date of Patent: Oct. 8, 2002

(54) SEALED-TYPE ELECTRIC COMPRESSOR HAVING REFRIGERANT PASSAGE

(75) Inventors: Yoshiaki Harakawa, Handa (JP); Yoshitaka Akiyama, Chiryu (JP); Masami Sanuki, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/742,896

(22) Filed: Dec. 21, 2000

(65) Prior Publication Data

US 2001/0012489 A1 Aug. 9, 2001

(30) Foreign Application Priority Data

Dec. 21, 1999 (JP) ..... 11-363143

(51) Int. Cl.[7] ..... F04B 17/00; F04B 39/02

(52) U.S. Cl. ..... 417/371; 417/366; 417/410.5; 418/55.1; 418/188

(58) Field of Search ..... 417/371, 372, 417/366, 368, 369, 410.5; 418/15, 100, 188, 55.1

(56) References Cited

U.S. PATENT DOCUMENTS 4,382,754 A * 5/1983 Shaffer et al. ..... 418/55
4,431,388 A * 2/1984 Eber et al. ..... 418/55
4,936,756 A * 6/1990 Shimizu et al. ..... 417/371
5,007,809 A * 4/1991 Kimura et al. ..... 417/371
5,110,268 A * 5/1992 Sakurai et al. ..... 417/410
6,042,346 A * 3/2000 Doi ..... 417/371

FOREIGN PATENT DOCUMENTS

JP 5-32596 5/1993

* cited by examiner

*Primary Examiner*—Charles G. Freay
*Assistant Examiner*—Han L. Liu
(74) *Attorney, Agent, or Firm*—Law Offices of David G. Posz

(57) ABSTRACT

A refrigerant passage within a main shaft includes an axial refrigerant passage extending in parallel with the main shaft from the end surface thereof, and a radial refrigerant passage communicating with the axial refrigerant passage and extending radially outwardly. The radial refrigerant passage is located between the end surface of the main shaft and a motor rotor. Thus, when the main shaft rotates, suctioned refrigerant is uniformly sprayed toward an entire coil. Further, the refrigerant flows toward a compression mechanism through the electric motor, thereby cooling the electric motor effectively.

7 Claims, 2 Drawing Sheets

SEALED-TYPE ELECTRIC COMPRESSOR HAVING REFRIGERANT PASSAGE

CROSS REFERENCE TO RELATED APPLICATION

This application is based on and incorporates herein by reference Japanese Patent Application No. Hei. 11-363143 filed on Dec. 21, 1999.

BACKGROUND OF THE INVENTION

1. Field of the Invention

The present invention relates to a sealed-type electric compressor having an electric motor and a compression mechanism within a compressor housing, suitable for use in a refrigerating cycle of an automotive air conditioning system.

2. Description of Related Art.

JP-B2-5-32596 discloses an electric scroll compressor used for a refrigerant cycle. In this electric scroll compressor, a housing rotatably supports a main shaft, and the main shaft is connected to a motor rotor and a compression mechanism. A first refrigerant passage is provided within the main shaft, and extends in parallel with the axis of the main shaft. Further, a second refrigerant passage is provided within the main shaft. The second refrigerant passage communicates with the first refrigerant passage and radially extends. A refrigerant flows through the first and second refrigerant passages, and into the front housing.

In the conventional electric scroll compressor, the refrigerant is discharged from the second refrigerant passage at the location between the motor rotor and the compression mechanism. Thus, the refrigerant does not sufficiently cool the motor.

SUMMARY OF THE INVENTION

A first object of the present invention is to cool an electric motor effectively by using a suctioned refrigerant.

A second object of the present invention is to arrange a refrigerant passage at an optimum location to improve a compressor working efficiency.

According to a first aspect of the present invention, a refrigerant passage within a rotor shaft includes a first refrigerant passage extending in parallel with a rotor shaft from the end surface thereof, and a second refrigerant passage communicating with the first refrigerant passage and extending radially outwardly. The second refrigerant passage is located between the end surface of the rotor shaft and a motor rotor.

Thus, when the rotor shaft rotates, suctioned refrigerant is uniformly sprayed toward a stator. Further, the refrigerant flows toward a compression mechanism through the electric motor, thereby cooling the electric motor effectively.

According to a second aspect of the present invention, a bearing supporter included at least two refrigerant passages for leading the refrigerant to the compression mechanism. At least one of the refrigerant passages is arranged close to an inlet port of the compression mechanism.

Thus, suction pressure loss is reduced, thereby improving the compressor efficiency.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
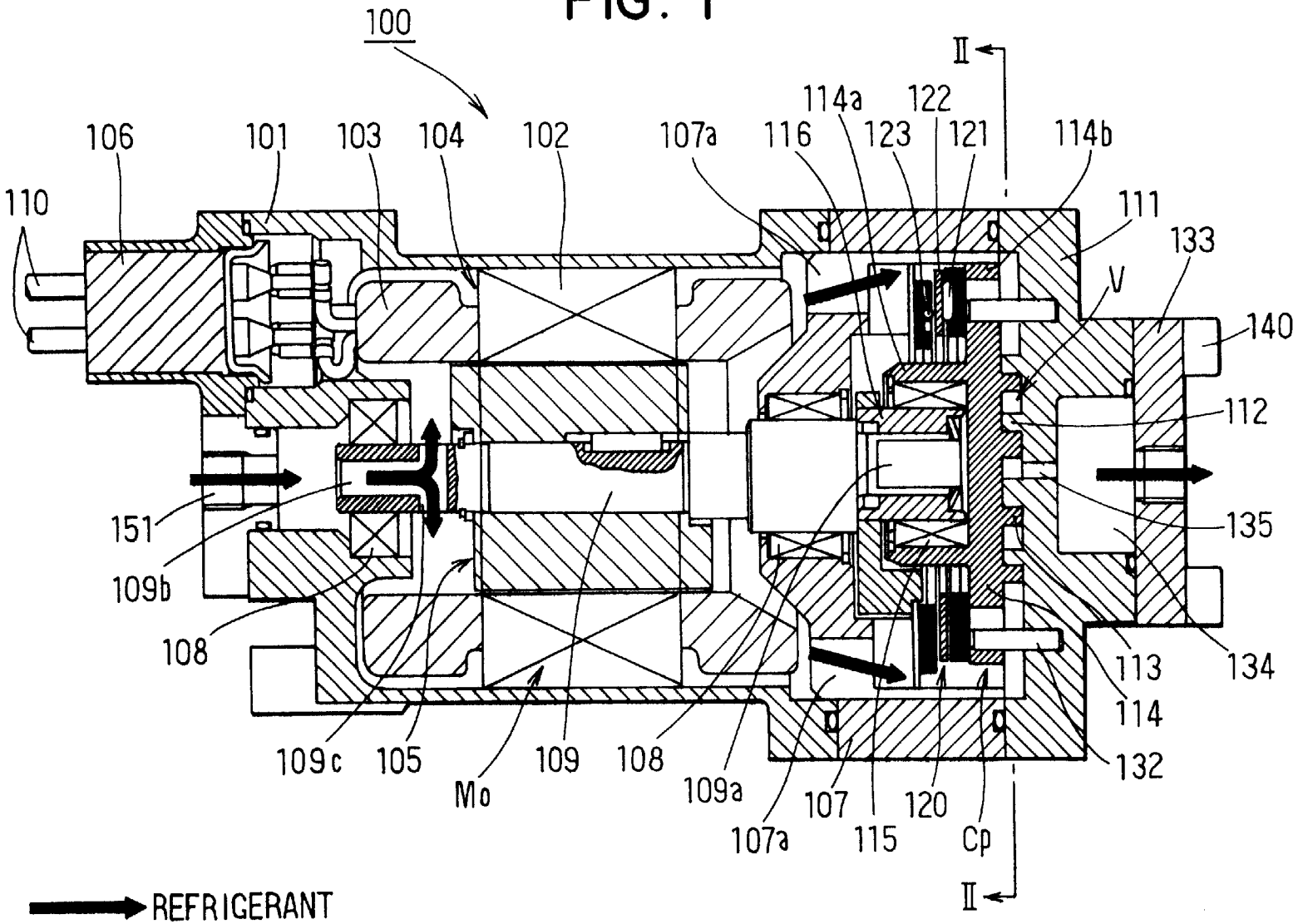
FIG. 1 is a cross sectional view showing an electric compressor.

FIG. 1 shows an axial cross-sectional view of the electric compressor 100. This compressor 100 is a sealed type compressor including a scroll compression mechanism Cp and an electric motor Mo (in this embodiment, a DC brush less motor) within an aluminum compressor housing. The compressor housing includes a front (motor) housing 101, a middle housing 107, a fixed scroll member 111 of the compression mechanism Cp, and a rear housing 133. The scroll compression mechanism Cp suctions and compresses the refrigerant, and the electric motor Mo drives the compression mechanism Cp.

The electric motor Mo includes a stator core 102 and a coil 103 forming a motor stator 104. The stator core 102 is fixed to the front housing 101, and is made of magnetic material such as silicon steel. The coil 103 is wrapped around the stator core 102.

The electric motor Mo further includes a motor rotor 105. The motor rotor 105 rotates inside the motor stator 104, and includes a plurality of permanent magnets (not illustrated) and a rotor core (not illustrated). The motor rotor 105 is fixed to a main shaft 109. The front housing 101 and the middle housing 107 rotatably supports the shaft 109 through a bearing 108. Terminals 110 supply electric power into the motor stator 104. An insulating resin 106 covers the terminals 110 to electrically insulate the terminals 110 with waterproof. The terminals 110 are connected to a motor driving circuit (not illustrated).

The main shaft 109 includes an axial refrigerant passage 109*b* horizontally extending from the front end of the shaft 109, and a radial refrigerant passage 109*c* communicating with the axial refrigerant passage 109*b* and radially extending. The refrigerant is suctioned through a suction port 151, and introduced into the front housing 101 through the refrigerant passages 109*b*, 109*c*.

The fixed scroll member 111 is fixed to the middle housing 107 and the front hosing 101 by bolts (not illustrated). The fixed scroll member 111 and the middle housing 107 form a compression mechanism space with together. The fixed scroll member 111 includes a spiral tooth 112 extending frontwardly and forming a compression chamber V.

The compression mechanism Cp includes a movable scroll member 114 provided between the middle housing 107 and the fixed scroll member 111. The movable scroll member 114 also includes a spiral tooth 113 extending rearwardly and contacting the spiral tooth 112 for forming the compression chamber V. When the movable scroll member 114 orbits with respect to the fixed scroll member 111, the refrigerant introduced into the front housing 101 flows into the compression chamber V through a refrigerant passage 107*a* within the middle housing 107. The volume of the compression chamber V expands and shrinks to suction and compress the refrigerant.

Figure 2:
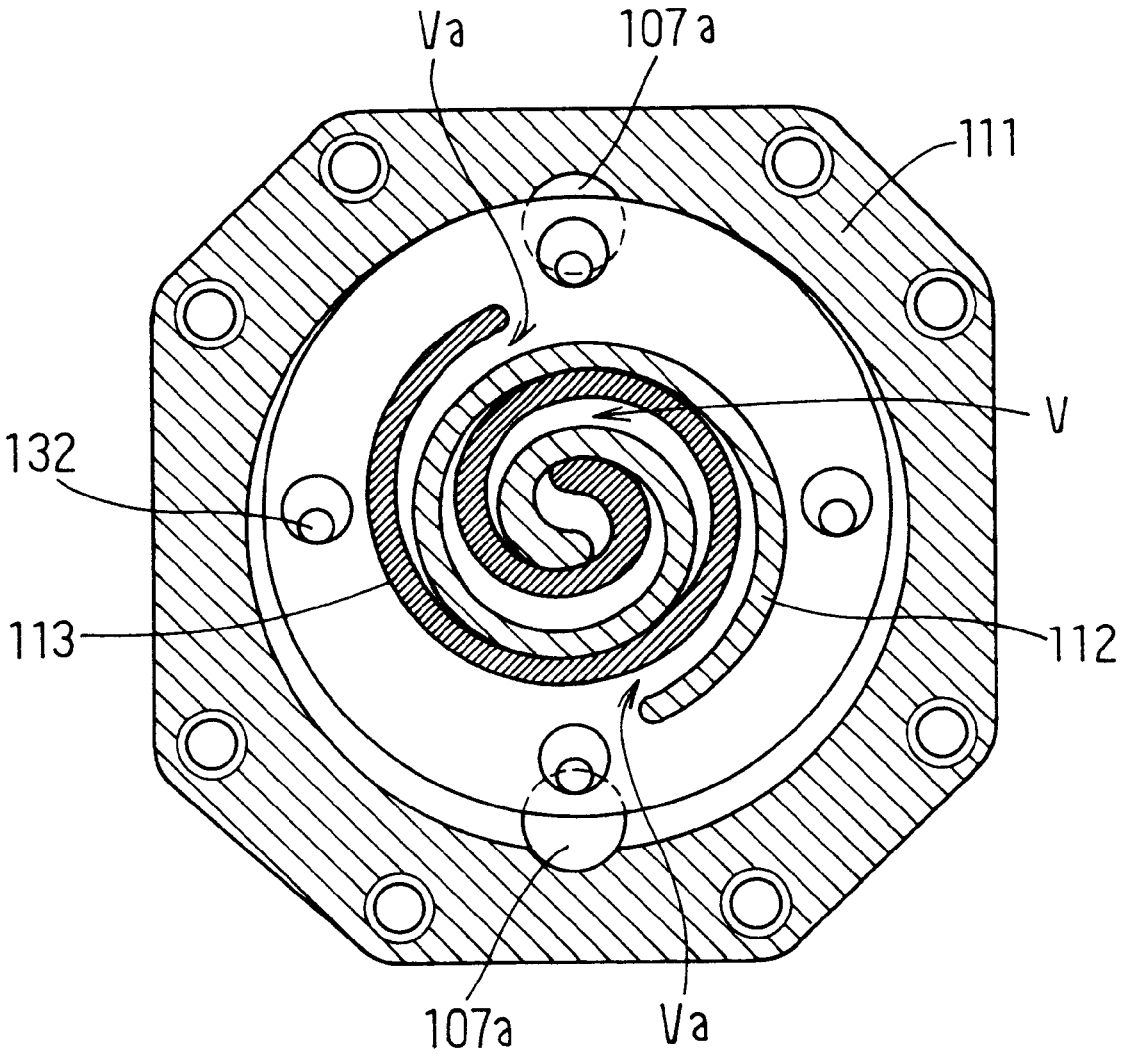
FIG. 2 is a cross-sectional view taken along line II—II in FIG. 1.

Here, as shown in FIG. 2, the refrigerant passage 107*a* is located close to suction ports Va of the compression chamber 107. The scroll compressor in the present embodiment includes two suction ports Va, so that two refrigerant passages 107*a* are provided.

The movable scroll member 114 includes a boss portion 114*a* at the center thereof. The boss portion 114*a* is connected to a crank portion 109*a* formed at the rear end of the main shaft 109 through a needle bearing 115.

The crank portion 109*a* is located eccentrically with respect to the rotation center of the main shaft 109. Thus, when the main shaft 109 rotates, the movable scroll member 114 orbits with respect to the main shaft 109.

A bushing 116 is provided between the crank portion 109*a* and the needle bearing 115. The busing 116 constructs a following crank mechanism which connects the movable scroll member 114 to the crank portion 109*a* slidably thereto and increases a contact surface pressure between both teethes 112 and 113. The bushing 116 allows the movable scroll member 114 to slightly slide with respect to the crank portion 109*a* by compression reaction force in an orbital direction, which acts on the movable scroll member 114.

A thrust bearing 120 is provided around the boss portion 114*a*. The thrust bearing 120 supports the movable scroll member 114 and receives a thrust force that is an axial component of the pressure reaction force acting on the movable scroll member 114.

The thrust bearing 120 includes a first roller 121, a thrust plate 122, and a second roller 123. The first roller 121 is cylindrically formed and supported to roll in one direction. The thrust plate 122 is provided between the first and second rollers 121 and 123. The second roller 123 is supported to roll in a direction perpendicular to the rolling direction of the first roller 121.

The thrust bearing 120 allows the movable scroll member 114 to slide in parallel with the middle housing 107 and the fixed scroll member 111.

A rotation block pin 132 is provided in the fixed scroll member 111. When the movable scroll member 114 orbits, the rotation block pin 132 prevents the movable scroll member 114 from rotating with respect to the crank portion 109*a*. The movable scroll member 114 includes a ring portion 114*b* formed at the radial outer area thereof, and the rotation block pin 132 slidably contacts with the inner wall of the ring portion 114*b*. Thus, when the main shaft 109 rotates, the movable scroll member 111 orbits with respect to the rotation center of the main shaft 109 without rotating around the crank portion 109*a*.

A discharge chamber 134 is formed between the fixed scroll member 111 and the rear housing 133. The pressure fluctuation of the refrigerant discharged from the compression chamber V is stabilized in the discharge chamber 134. The rear housing 111 is fixed to the fixed scroll member 111 by a bolt 140.

A discharge port 135 is formed at the center of the fixed scroll member 111. The compression chamber V communicates with the discharge chamber 132 through the discharge port 135. A lead type discharge valve (not illustrated) and a stopper are provided at the rear side of the discharge port 135. The discharge valve prevents the refrigerant from flowing back from the discharge chamber 134 to the compression chamber V. The stopper restricts the maximum opening of the discharge valve.

An operation of the above-described electric compressor will be explained.

The refrigerant suctioned through the suction port 151 is introduced into the front housing 101 through the axial passage 109*b* and the radial passage 109*c*. Here, when the main shaft 109 rotates, the refrigerant is uniformly sprayed toward the entire coil 103. Further, since the radial refrigerant passage 109*c* is located at a refrigerant upstream side (front side) of the electric motor Mo, the refrigerant flows toward the refrigerant passage 107*a* through the electric motor Mo, thereby cooling the electric motor effectively. As a result, an electric motor working efficiency is improved, thereby improving an entire compressor working efficiency. Further, since the refrigerant passage 107*a* within the middle housing 107 is located close to the inlet port Va of the chamber V, suction pressure loss is reduced, thereby improving the compressor working efficiency.

According to the above-described embodiment, the electric compressor of the present invention is applied to a horizontal electric compressor as shown in FIG. 1. Alternatively, the electric compressor may be applied to a vertical electric compressor.

The above-described electric compressor may be applied to a supercritical refrigerant cycle for which carbon dioxide is used as refrigerant, and may be applied to a supercritical refrigerant cycle for which ethylene, ethane, nitrogen oxide, and the like are used as refrigerant. Further, the electric compressor may be applied to a refrigerant cycle for which fron (HFC134) is used as refrigerant.

According to the above-described embodiment, a pin-ring type rotation block mechanism including the rotation block pin 132 and the ring portion 114*b* is used. Alternatively, other rotation block mechanism may be used.

What is claimed is:

1. An electric compressor for compressing refrigerant comprising:

a housing forming an outer casing;

a compression mechanism provided in the housing for suctioning and compressing the refrigerant;

an electric motor driving the compression mechanism, the electric motor including a stator, a rotor rotating inside the stator, and a rotor shaft, the rotor shaft defining an end surface thereof;

a motor chamber provided in the housing, where the electric motor is installed;

a suction port introducing the refrigerant into the housing, the suction port facing the end surface of the rotor shaft;

a refrigerant passage provided in the rotor shaft for guiding the refrigerant suctioned through the suction port to the compression mechanism, the refrigerant passage including a first refrigerant passage extending in parallel with the rotor shaft from the end surface of the rotor shaft, and a second refrigerant passage communicating with the first refrigerant passage and extending radially outwardly, wherein the second refrigerant is located between the end surface of the rotor shaft and the rotor;

a bearing provided between the motor chamber and the compression mechanism for supporting the rotor shaft;

a bearing supporter provided between the motor chamber and the compression mechanism for supporting the bearing, the bearing supporter including at least two refrigerant passages for leading the refrigerant to the compression mechanism, wherein at least one of the refrigerant passages is arranged close to an inlet port of the compression mechanism.

2. An electric compressor according to claim 1, further comprising another bearing for supporting an outer surface of the rotor shaft within which the first refrigerant passage is located.

3. An electric compressor according to claim 2, wherein:

the housing defines a suction port and has a cylindrical portion in which the another bearing is supported; and the cylindrical portion defines a conduit connecting the suction port with the first refrigerant passage.

4. An electric compressor according to claim 1, wherein:

the compression mechanism includes a movable member and a compressor bearing for supporting the movable member; and the compressor bearing is located closer to the bearing supporter than the movable member.

5. An electric compressor according to claim 4, wherein:

the compression mechanism includes a circular member that is located between the bearing supporter and the inlet port of the compression mechanism;

the circular member radially extends beyond the inlet port; and the refrigerant passages have openings at radial outsides of the circular member so as to provide axial communication with the compression mechanism.

6. An electric compressor according to claim 5, wherein:

the circular member is a movable member that is driven by the rotor shaft; and the openings of the refrigerant passages radially open outside of a circular track of the movable member.

7. An electric compressor according to claim 1, wherein the rotor shaft is for causing the refrigerant to be uniformly sprayed toward a coil wrapped around the stator.

* * * * *